US005542454A

United States Patent [19]

Carlson et al.

[11] Patent Number: 5,542,454

[45] Date of Patent: Aug. 6, 1996

[54] FREE FLOW LOW ENERGY PIPE PROTECTOR

[75] Inventors: Douglas W. Carlson; Stephen P. Simons, both of Houston, Tex.

[73] Assignee: Hydrill Company, Houston, Tex.

[21] Appl. No.: 224,753

[22] Filed: Apr. 8, 1994

[51] Int. Cl.[6] ..... F16L 57/00

[52] U.S. Cl. ..... 138/110; 138/108; 175/325.5; 175/325.6

[58] Field of Search ..... 138/110, 108, 138/96 R, 96 T, 177, 178; 175/325.6, 325.7, 325.5

[56] References Cited

U.S. PATENT DOCUMENTS

| | | | |
|---|---|---|---|
| 1,889,060 | 11/1932 | Dennie | 175/325.7 |
| 1,894,519 | 1/1933 | McLaine | 175/325.6 |
| 1,940,332 | 12/1933 | Smith | 175/325.6 |
| 2,252,978 | 8/1941 | Parkin | 175/325.6 |
| 2,722,462 | 11/1955 | Tschirley | 175/325.5 |
| 3,094,018 | 6/1963 | Collett . | |
| 3,129,982 | 4/1964 | Fawick | 175/325.6 |
| 3,148,004 | 9/1964 | Hall et al. . | |
| 3,164,216 | 1/1965 | Hall, Sr. et al. . | |
| 3,197,262 | 7/1965 | Fairchild . | |
| 3,227,498 | 1/1966 | Leathers . | |
| 3,294,122 | 12/1966 | Sharp | 138/110 |
| 3,397,017 | 8/1968 | Grant et al. . | |
| 3,410,613 | 11/1968 | Kuus . | |
| 3,411,837 | 11/1968 | Schellstede . | |
| 3,425,757 | 2/1969 | Minor . | |
| 3,449,022 | 6/1969 | Minor . | |
| 3,458,922 | 8/1969 | Schellstede et al. . | |
| 3,480,094 | 11/1969 | Morris | 175/325.5 |
| 3,484,122 | 12/1969 | Schellstede et al. . | |
| 3,588,199 | 6/1971 | Hopmans . | |
| 3,709,569 | 1/1973 | Napper . | |
| 3,804,168 | 4/1974 | Marshall et al. . | |
| 3,893,778 | 7/1975 | Williams . | |
| 3,894,780 | 7/1975 | Broussard . | |
| 3,948,575 | 4/1976 | Rosser . | |
| 3,999,811 | 12/1976 | Gray . | |
| 4,072,369 | 2/1978 | Segreto . | |
| 4,279,850 | 7/1981 | Lynch . | |
| 4,281,722 | 8/1981 | Tucker et al. . | |
| 4,318,426 | 3/1982 | Callanan et al. . | |
| 4,354,529 | 10/1982 | Soutos et al. . | |
| 4,398,772 | 8/1983 | Odell . | |
| 4,796,670 | 1/1989 | Russell et al. . | |
| 4,907,661 | 3/1990 | Lloyd . | |
| 5,069,297 | 12/1991 | Krueger et al. . | |

FOREIGN PATENT DOCUMENTS

| | | | |
|---|---|---|---|
| 640788 | 7/1950 | United Kingdom | 175/325.5 |

OTHER PUBLICATIONS

Garkasi, Ali, Russell W. Hall, Jr., and W. Gregory Deskins, "Laboratory Drill Pipe Protector Test", Drilling Technology, PD—vol. 56, 1994, pp. 63–68.

*Primary Examiner*—David Scherbel
*Assistant Examiner*—Patrick F. Brinson
*Attorney, Agent, or Firm*—Vaden, Eickenroht, Thompson & Feather

[57] ABSTRACT

A pipe protector has been designed to provide free flow and low energy. The outside surface has a bilateral asymmetrical pattern when comparing the approximate top half of the pipe protector to the bottom half of the pipe protector. The pattern has raised figures surrounded by communicating channels.

7 Claims, 3 Drawing Sheets

FREE FLOW LOW ENERGY PIPE PROTECTOR

BACKGROUND AND SUMMARY OF THE INVENTION

Pipe protectors are tubular rubber members that surround pipe in downhole drilling operations. The rubber pipe protector contacts metal casing into which the pipe is introduced during the drilling operation. During drilling well completion fluids and drilling mud may be circulated in the annular space between the casing and the outside surface of the drill pipe. This annular space in the well also contains the pipe protector.

Pipe protectors with a slick or smooth outer surface provide maximum wear surface contacting the well casing. During the drilling operation the pipe is rapidly rotated. Directional or deviated drilling is at an angle in a non-vertical direction. The smooth surface pipe protectors are suited to high wear applications in directional drilling, but smooth pipe protectors restrict flow in tight holes.

Pipe protectors with fluted channels cut out of the outside surface provide fluid flow in tight holes. However, during rotation of the drill pipe the fluted configuration develop large vibration in tight holes especially during deviated drilling. Pipe protectors with the flutes cut in a spiral have been used. The spiral cut also produces large vibrations in deviated drilling.

The improved drill pipe protector of this invention combines the benefits of sufficient surface area for good wear characteristics and channels for fluid flow with low rotational energy requirements and vibration suppression. The tubular rubber member is sized to a pre-selected inner diameter to the approximate outside diameter of a pipe. A pattern on the outside surface of the rubber tubular member is made of raised surfaces surrounded by communicating channels. The pattern is bilaterally asymmetrical when comparing the pattern on the approximate top half of the pipe protector to the pattern on the approximate bottom half of the pipe protector. In one embodiment the pattern uses the same geometric figure such as a diamond. The diamonds are not of the same size and configuration to provide the bilateral asymmetry at the midline of the pipe protector. A combination of geometric and irregular figures can be used to create the midline asymmetry. In order to provide for fluid flow the channels comprise from about 40% to about 70% of the pattern. The raised patterned surface is from 30% to 60% of the outside surface area to minimize wear during operation. The raised surfaces may have a rounded outer contour.

The improved pipe protector can be adapted for use on pipe protectors known to those in the industry. A preferred design is a conventional split type pipe protector which has an opening the length of the tubular rubber member capable of separation at the opening to facilitate the installation on to a pipe. A closing means is provided to secure the tubular member around a pipe. Many split type pipe protectors have interlocking metal teeth covered by rubber and locked together with a key fastener inserted lengthwise through the teeth. The metal teeth are connected to a cylindrical metal insert inside the tubular rubber member. The metal insert may be smooth or corrugated metal. The split type pipe protector of the present invention has a pattern on the outside as described herein. Although the preferred embodiment of this invention is for a split type protector, the asymmetric pattern can also be used with a stretch-on type protector which is installed on the pipe by temporarily stretching or enlarging the inside diameter of the pipe protector to such a degree that the protector can be slipped over the end of the pipe.

DETAILED DESCRIPTION OF THE INVENTION

Figure 1:
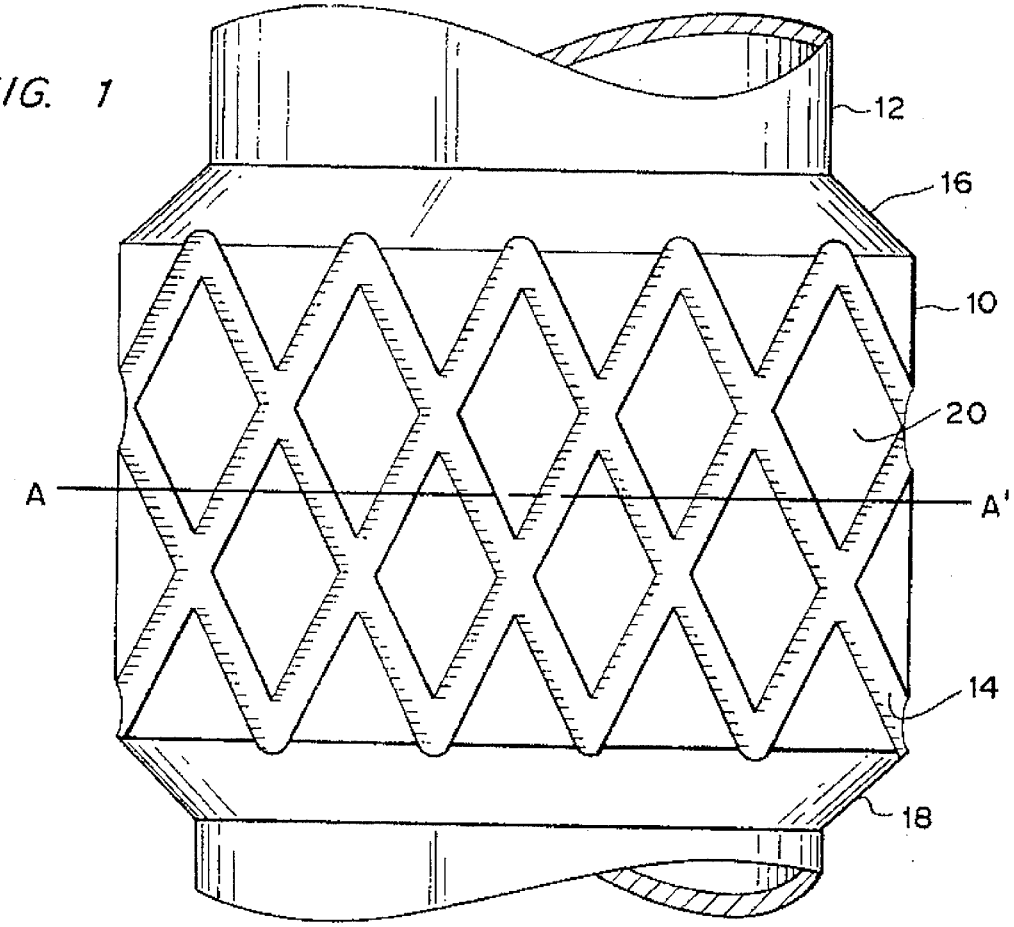
FIG. 1 is a side view of a pipe protector with a diamond and channel pattern with midline asymmetry installed on to a pipe.

The pipe protectors of this invention can be made from polymers generally used for downhole drilling, and known to those skilled in the art. A preferred rubber is high acrylonitrile butadiene copolymer also known as nitrile base polymer. The range of durometer hardness for the tubular member is from about 50 Shore A to about 80 Shore A. The preferred range is from about 65–70 Shore A durometer hardness.

The acrylonitrile copolymer rubber has oil and fuel resistance, high tensile and tear strength, abrasion and gas impermeability resistance and heat resistance. The acrylonitrile copolymer rubber can be compounded with other additives known to those skilled in the art to improve and enhance certain characteristics.

A preferred polymer formula for a colored noncarbon reinforced rubber is shown in Table 1 below.

TABLE 1

Colored Non Carbon Reinforced Polymer

| Component | Parts Per Hundred Polymer |
|---|---|
| NBR Polymer | 100 |
| Zinc Oxide | 4–9 |
| Silica | 25–60 |
| Stearic Acid | 1.0–1.5 |
| Antioxidants and Antiozonants | 3.5–10.0 |
| Processing Oils | 25–50 |
| Reinforcing Resin and Resin Curative | 5–15 |
| Iron Oxide Colorant | 3–8 |
| Sulfenamide Curative | 2–5.5 |
| Thiuram Curative | 1.5–4.5 |

A preferred polymer formula for a carbon black reinforced polymer stock is shown in Table 2 below.

TABLE 2

Black Carbon Reinforced Polymer

| Component | Parts Per Hundred Polymer |
|---|---|
| NBR Polymer | 100 |
| Zinc Oxide | 4–9 |
| Stearic Acid | 1.0–1.5 |
| Carbon Black (N774) | 30–70 |

TABLE 2-continued

| Black Carbon Reinforced Polymer | |
|---|---|
| Component | Parts Per Hundred Polymer |
| Antioxidant and Antiozonants | 3.5–10.0 |
| Processing Oils | 25–50 |
| Reinforcing Resin and Resin Curative | 5–15 |
| Sulfenamide Curative | 2–5.5 |
| Thiuram Curative | 1.5–4.5 |

The pattern on the pipe protector is created by channels in the rubber on the outer surface. The channels surround a geometrical or irregular figure that is raised relative to the channel. The channel may be formed in any manner so long as fluid may flow there through. The channel may be a smooth semicircular U-shaped cut, a V-shaped cut or square cut. This list is not intended to exclude any channel form that allows for fluid flow. The channels on one pipe protector can be a combination of a variety of cuts. The channels extend to the shoulder of a split type pipe protector to allow for fluid flow past the pipe protector. The shoulders slope toward the inner diameter of the tubular member. The channels can be from about 40% to about 70% of the outside surface area on the pipe protector.

The pattern created by the channels has midline or bilateral asymmetry so that the pattern on the approximate top half of the pipe protector is asymmetrical when compared to the approximate bottom half. The same geometric or irregular shape may be used or a mixture of shape. Geometric shapes that can be formed by the channels are diamonds, ellipses, circles, ovals, rectangles, hemispheres, parallelograms, trapezoids, triangles, multi-sided figures and irregular sided figures. This list is not intended to exclude any shape or form but is intended to be illustrative of the numerous figures that can be used. The surface of the raised figures may be flat or rounded.

FIG. 1 illustrates a preferred embodiment of the pipe protector of the present invention. The tubular rubber member 10 is shown installed on to pipe 12. Channels, one of which is illustrated at reference numeral 14, are cut or molded on the outside surface of tubular member 10. The channels extend to shoulders 16 and 18 on either end of tubular member 10 to allow fluid flow. The channels create raised surfaces, and in FIG. 1, are shown as diamonds one of which is illustrated at reference numeral 20. Line A–A' is the approximate midline of tubular member 10 and is drawn to illustrate the bilateral asymmetry when comparing the approximate top half to the approximate bottom half of the pipe protector.

Figure 2:
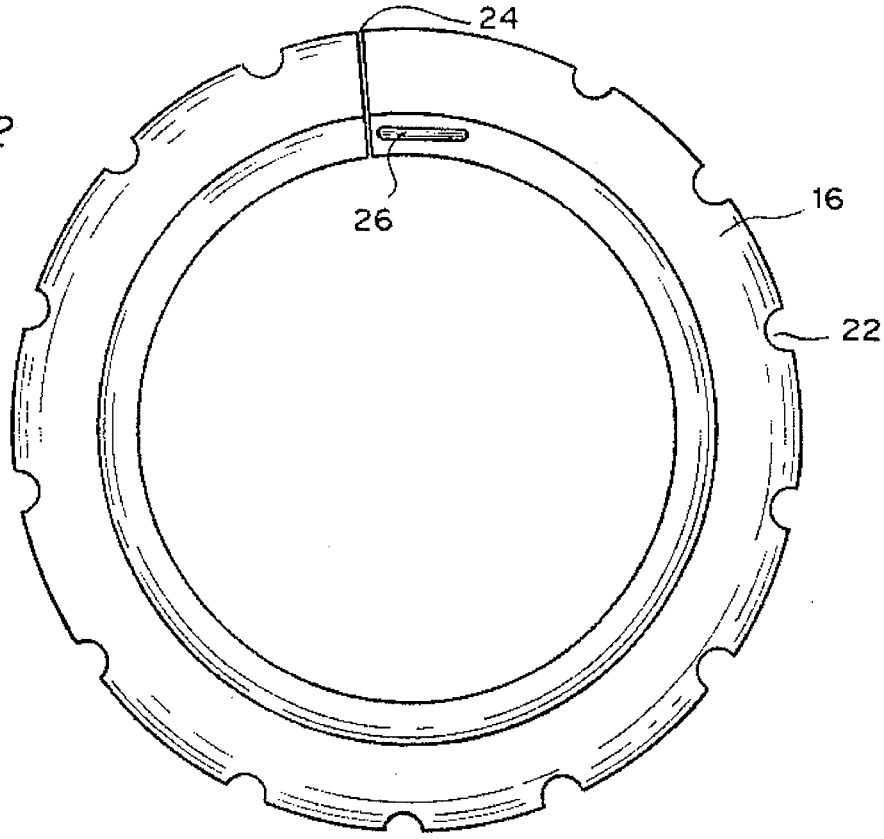
FIG. 2 is a top view of the diamond and channel pipe protector of FIG. 1 not installed on to a pipe.

FIG. 2 is a top view of the pipe protector of FIG. 1 not installed on to a pipe. The channels that extend to shoulder 16 are shown as U-shaped or semicircular cuts. One of such channels is shown at reference numeral 22. The top view shows a typical split type pipe protector as described herein with opening 24 and key 26 used to close the protector around the pipe.

Figure 3:
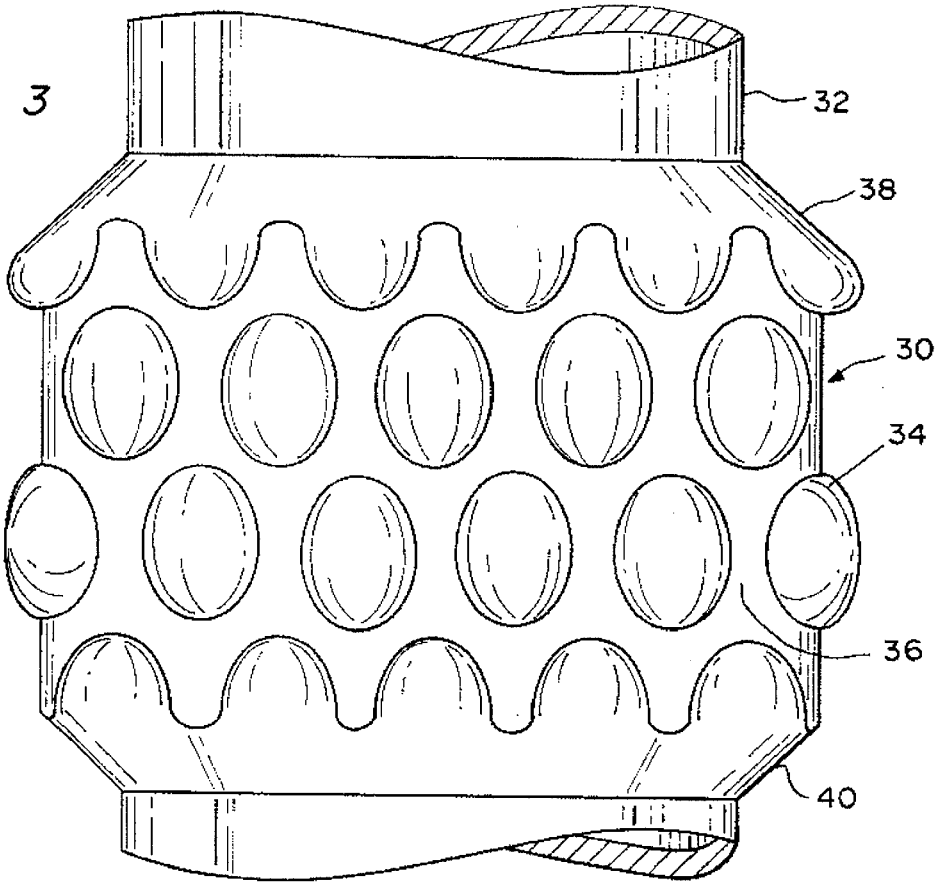
FIG. 3 is a side view of a pipe protector with raised oval design and midline asymmetry installed on to a pipe.

FIG. 3 is a side view of an alternative embodiment that illustrates the use of a rounded contour on the raised surfaces with an asymmetric oval pattern. The pipe protector generally indicated at reference numeral 30 is installed on to pipe 32. A series of raised ovals, one of which is indicated at reference numeral 34, are arranged to provide bilateral asymmetry with the approximate top half and the bottom half of the pipe protector. Channels are provided around the raised, rounded oval pattern as indicated at reference numeral 36 for fluid flow as previously described herein. The channels extend to shoulders 38 and 40.

Figure 4:
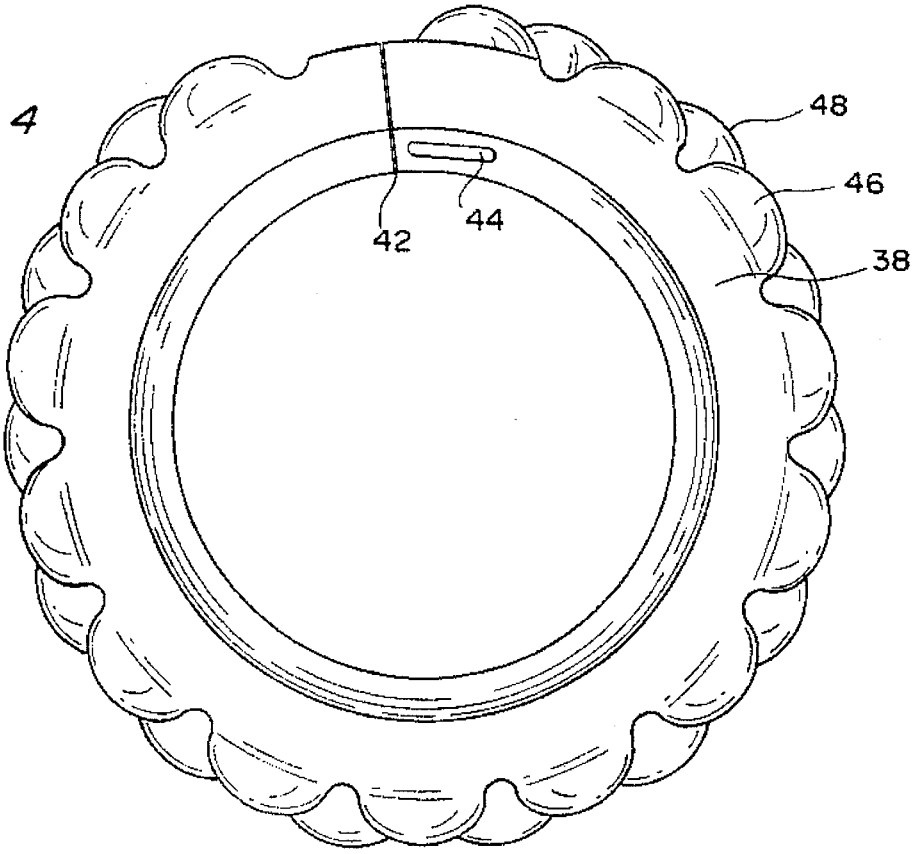
FIG. 4 is a top view of the raised oval pipe protector of FIG. 3 not installed on to a pipe.

FIG. 4 is a top view of the pipe protector shown in FIG. 3 that is not installed on to a pipe. The top view shows the typical split type pipe protector with opening 42 and key 44 used to close the protector around the pipe. The series of offset raised, rounded ovals are shown with the top row as illustrated at reference numeral 46 truncated and blended into the shoulder 38. A row of offset ovals illustrated at reference numeral 48 can be seen in this view.

Figure 5:
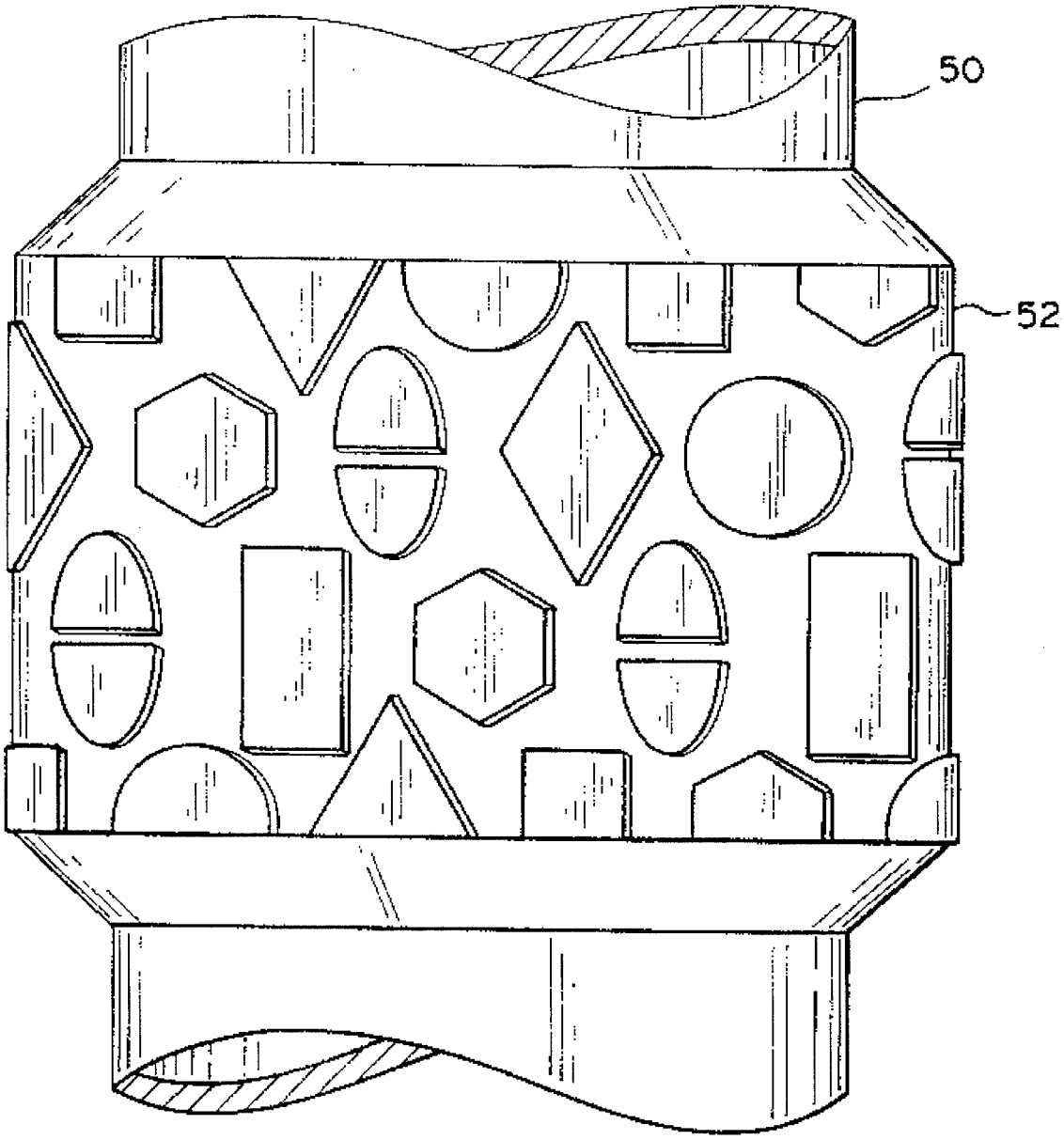
FIG. 5 is a side view of a pipe protector with a variety of figures installed on to a pipe.

FIG. 5 is the side view of another embodiment of the pipe protector of the present invention with multiple designs as it is installed on pipe 50. The tubular member 52 has a variety of shapes such as hexagons, semi-circles, circles, diamonds, rectangles and truncated shapes making up a bilateral asymmetrical pattern on the outside surface. The figures are raised and channels can be the irregular spaces between the figures.

The pipe protector of the present invention demonstrates low vibratory energy under drilling conditions. The diamond pattern pipe protector of a design similar to that shown in FIGS. 1 and 2 was tested and compared to slick and fluted pipe protectors. The pipe protectors were tested at actual loads encountered in the field. The height of the pipe protectors is 4 inches from shoulder to shoulder with an overall height of 6 inches. The pipe protectors were tested at 3000 and 6000 lbs/foot lateral load and 158 rpm. The vibratory energy measurement was derived by measuring the amplitude of the fundamental wave and adding to it the amplitude of the first, second, third and fourth harmonic. This sum is converted to energy units which are proportional to the amplitude measurement. The resulting number for vibratory energy is used for comparative purposes among the pipe protectors tested.

The following Table 3 is a summary tests on vibratory energy for an asymmetrical diamond pattern, smooth and fluted pipe protector.

TABLE 3

| Vibratory Energy | | | |
|---|---|---|---|
| Load | Pipe Protector Pattern | | |
| (lbs/ft.) | Diamond | Smooth | Fluted |
| 3000 | 77.35 | 99.53 | 241.83 |
| 6000 | 67.22 | 100.34 | 265.45 |

In a comparison of the asymmetrical diamond pattern to the conventional smooth and fluted pipe protectors, the value for the asymmetrical diamond pattern was assigned the value 1 with the other numbers adjusted proportionally. The following Table 4 illustrates the reduced vibratory energy of the pipe protector of the present invention.

TABLE 4

| Vibratory Energy Ratio | | | |
|---|---|---|---|
| Load | Pipe Protector Pattern | | |
| (lbs/ft.) | Diamond | Smooth | Fluted |
| 3000 | 1 | 1.28 | 3.12 |
| 6000 | 1 | 1.49 | 3.94 |

The examples provided in this specification are not intended to limit the scope of the claimed invention. Those skilled in the art will appreciate additional embodiments and variations that can be practiced based in addition to those disclosed herein.

What is claimed is:

1. A pipe protector comprising:

a tubular rubber member for installing on a joint of drill pipe for rotation therewith within a well casing;

a pattern formed in the outside surface of the tubular rubber member of integral raised surfaces of rubber surrounded by a plurality of pairs of communicating channels in the outer surface of the rubber member through which drilling fluid can bypass the protector;

the pairs of communicating channels starting at equally spaced points around the lower edge of the outside surface and extending upwardly at the same angle from the plane of the longitudinal axis of the protector along divergent paths so that the channels intersect and leave a pattern of diamond-shaped raised surfaces to engage the wall of the casing while drilling fluid flows past the protector through the channels; and said pattern being bilaterally asymmetrical when comparing the pattern on the approximate top half of the pipe protector to the pattern of the approximate bottom half.

2. A pipe protector of claim 1 wherein said communicating channels comprise from about 40% to about 70% of the pattern formed in the outside surface of the pipe protector.

3. A pipe protector of claim 1 having an opening the length of the tubular member capable of separation at the opening to facilitate installation on to a pipe and a closing means to secure the tubular rubber member around the pipe.

4. A pipe protector of claim 1 wherein the raised surfaces surrounded by communicating channels have a rounded outer contour.

5. A pipe protector of claim 1 wherein the tubular member is a stretch-on type protector.

6. A pipe protector of claim 1 wherein said raised surfaces comprise from about 30% to about 60% of the pattern in the outside surface of the tubular member.

7. A pipe protector of claim 1 additionally comprising sloped shoulders on either end of said tubular member sloping toward the inner diameter of the tubular member and said channels extending to the shoulders.

* * * * *

UNITED STATES PATENT AND TRADEMARK OFFICE

CERTIFICATE OF CORRECTION

PATENT NO. : 5,542,454

DATED : August 6, 1996

INVENTOR(S) : Douglas W. Carlson and Stephen P. Simons

It is certified that error appears in the above-indentified patent and that said Letters Patent is hereby corrected as shown below:

ON THE TITLE PAGE:

-- (73) Assignee: Hydril Company, Houston, Tex. --

The company name was misspelled. "Hydrill" should be corrected to --Hydril--.

Signed and Sealed this

Fifteenth Day of April, 1997

Bruce Lehman

*Attest:*

BRUCE LEHMAN

*Attesting Officer*

*Commissioner of Patents and Trademarks*